US007586456B2

(12) United States Patent
Yeh et al.

(10) Patent No.: US 7,586,456 B2
(45) Date of Patent: Sep. 8, 2009

(54) BROADBAND ANTENNA

(75) Inventors: Shih-Huang Yeh, Douliou (TW); Kin-Lu Wong, Kaohsiung (TW); Yun-Wen Chi, Sinjhuang (TW)

(73) Assignees: Industrial Technology Research Institute, Hsinchu (TW); National Sun Yat-Sen University, Kaohsiung (TW)

( * ) Notice: Subject to any disclaimer, the term of this patent is extended or adjusted under 35 U.S.C. 154(b) by 64 days.

(21) Appl. No.: 11/503,235

(22) Filed: Aug. 14, 2006

(65) Prior Publication Data

US 2008/0122699 A1 May 29, 2008

(30) Foreign Application Priority Data

Jun. 15, 2006 (TW) ..... 95121386 A

(51) Int. Cl.
*H01Q 9/28* (2006.01)

(52) U.S. Cl. ..... 343/795

(58) Field of Classification Search ..... 343/795, 343/700 MS, 767

See application file for complete search history.

(56) References Cited

U.S. PATENT DOCUMENTS

| | | | | |
|---|---|---|---|---|
| 5,182,570 | A * | 1/1993 | Nysen et al. | 343/795 |
| 7,148,849 | B2 * | 12/2006 | Lin | 343/700 MS |
| 7,391,384 | B2 * | 6/2008 | Wong et al. | 343/795 |
| 2004/0140941 | A1 | 7/2004 | Joy et al. | 343/795 |
| 2004/0178957 | A1 | 9/2004 | Chang et al. | |
| 2006/0187135 | A1 * | 8/2006 | Maniwa et al. | 343/795 |
| 2006/0284780 | A1 * | 12/2006 | Chen et al. | 343/795 |

FOREIGN PATENT DOCUMENTS

| | | | |
|---|---|---|---|
| GB | 2029112 | A | 3/1980 |
| WO | WO2004/077610 | A | 9/2004 |

OTHER PUBLICATIONS

Liu et al., Zi Dong; Dual-Frequency Planar Inverted-F Antenna; Transactions on Antennas and Propagation; Oct. 1997; vol. 45, No. 10, pp. 1451-1458.

DVB-T Antenna; May 28, 2006; p. 1 of 1; Inpaq Technology Co., Ltd.

Author: Uknown, "DVB-T NB/PC/Car Antenna" May 28, 2006; p. 1 of 1; Inpaq Technology Co., Ltd.

Author: Unknown, "Product Specification, Automobile Digital Antenna for DVB102" Date, Pertinent Pages & Place of Publication: Unknown, (English & Chinese, 2 pages total).

* cited by examiner

*Primary Examiner*—Tan Ho
(74) *Attorney, Agent, or Firm*—Bacon & Thomas, PLLC

(57) ABSTRACT

A broadband antenna includes a dielectric substrate, a radiation conductor and a feeding gap. The radiation conductor is disposed on the dielectric substrate and has a first side and a second side. The first side is adjacent to the second side, and the first side is longer than the second side. The second side has a first feeding point and a second feeding point. The feeding gap has a first end located at the first side and a second end located at the second side. The feeding gap divides the radiation conductor into a first sub-radiation conductor and a second sub-radiation conductor. The first feeding point is located on the first sub-radiation conductor and the second feeding point is located on the second sub-radiation conductor.

11 Claims, 7 Drawing Sheets

BROADBAND ANTENNA

This application claims the benefit of Taiwan application Ser. No. 95121386, filed Jun. 15, 2006, the subject matter of which is incorporated herein by reference.

BACKGROUND OF THE INVENTION

1. Field of the Invention

The invention relates in general to a broadband antenna, and more particularly to a broadband dipole antenna that is fed at one short side to enlarge the antenna bandwidth.

2. Description of the Related Art

Along with technological progress, the need for broadband antennas has been increasing rapidly. For example, people can easily watch digital TV via portable TV products. Digital TV is a television system which converts analog signals to digital signals, and Taiwan now uses a European digital video broadcasting terrestrial (DVB-T) system. The DVB-T system can effectively solve a multi-path interruption problem by using modulation standard signals. The European-specification system constructs a single frequency network (SFN) to increase accessible frequency spectrum resources. In addition, the European TV system has a feature of mobile reception and thus people can watch TV even in a car running at a high speed of 130 km/hr.

For example, in early periods, antenna technologies of advanced channel estimation and dual antenna reception for distribution and integration were developed in order to improve mobile reception function of the DVB-T receiver disposed in a car. However, these technologies resulted in system complexity, higher hardware costs, and higher antenna power consumption. In the present market, a conventional digital TV antenna used in a car is a monopole antenna. The monopole antenna uses the car shell as a grounded surface, but this greatly affects the appearance of the car and and decreases the car's attractiveness. Also, due to the shielding effects of the car's metal shell, the antenna's ability to receive signals becomes degraded.

Recently, technology of a dipole antenna for digital TV reception has been developed. Conventionally, owing that signals are fed into the central part of the dipole antenna symmetrically via a coaxial line, the coaxial line will not be parallel to the direction of two arms of the dipole antenna. Therefore, in practical application, the coaxial line needs to be perpendicular to the digital TV antenna, thereby increasing the volume of the antenna. When the digital TV antenna is disposed in a car, it will further affect the aethestic appearance of the car. In addition, due to the narrow width of the antenna's radiation conductor, the antenna's bandwidth may be inadequate.

SUMMARY OF THE INVENTION

It is therefore an object of the invention to provide a broadband antenna. By feeding signals to one short side of the antenna, the coaxial line can be oriented along the direction of a radiation conductor of the antenna. Therefore, the antenna can have a smaller size and thickness, larger bandwidth and more convenience in configuration without reducing antenna performance and attractiveness The invention achieves the above-identified object by providing a broadband antenna including a dielectric substrate, a radiation conductor and a feeding gap. The radiation conductor is disposed on the dielectric substrate and has a first side and a second side. The first side is adjacent to the second side, and the first side is longer than the second side. The second side has a first feeding point and a second feeding point. The feed gap has a first end located at the first side and a second end located at the second side. The feed gap divides the radiation conductor into a first sub-radiation conductor and a second sub-radiation conductor. The first feeding point is located on the first sub-radiation conductor and the second feeding point is located on the second sub-radiation conductor.

Other objects, features, and advantages of the invention will become apparent from the following detailed description of the preferred but non-limiting embodiments. The following description is made with reference to the accompanying drawings.

DETAILED DESCRIPTION OF THE INVENTION

In the broadband antenna of the invention, signals are fed into one short side of the antenna, and the coaxial line used as a feeding circuit oriented along the direction of the radiation conductor. Therefore, the antenna can have a smaller size and thickness, larger bandwidth and more convenience in configuration without reducing antenna performance and attractiveness. The broadband antenna of the invention can enlarge operating bandwidth by feeding signals to one short side, and can be applied to receive signals of various frequencies. Any antenna with a dipole antenna structure can use this method of feeding signals to one short side in the antenna to increase the bandwidth and flexibity in configuration no matter which frequency band the antenna is applied in.

Figure 1:
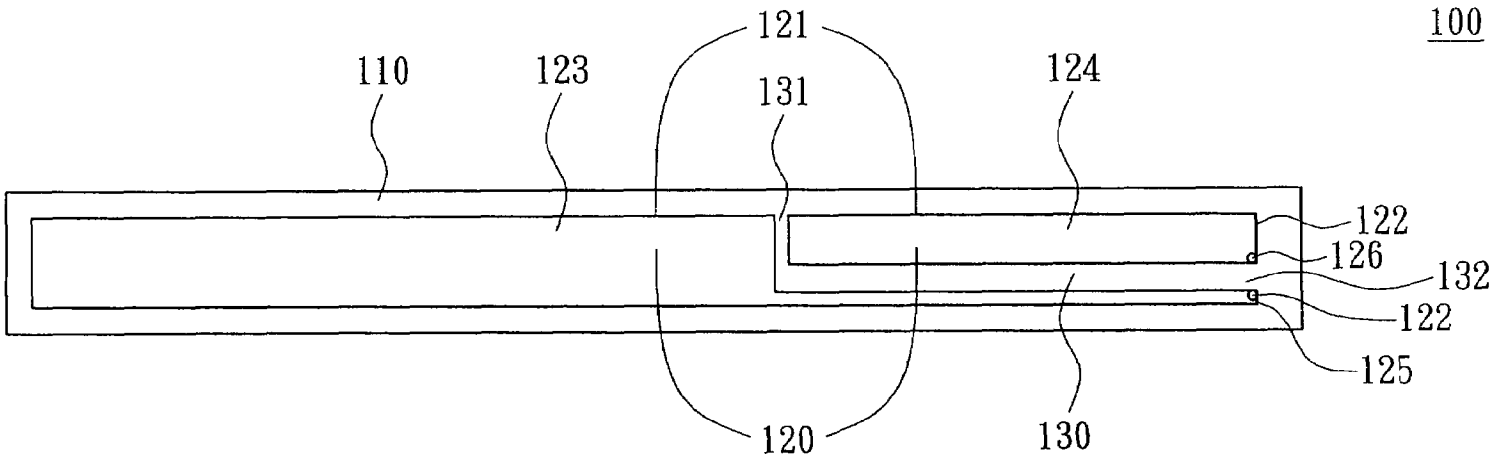
FIG. 1 is a schematic diagram of a broadband antenna according to a preferred embodiment of the invention.

Referring to FIG. 1, a schematic diagram of a broadband antenna according to a preferred embodiment of the invention is shown. The broadband antenna 100 includes a dielectric substrate 110, a radiation conductor 120 and a feeding gap 130. The radiation conductor 120 can be a radiation metal plate or other conductive materials, such as made of indium tin oxide (ITO) and is formed on the dielectric substrate 110 by a method of printing or etching. The radiation conductor 120 has a first side 121 and a second side 122 and the first side 121 is adjacent to the second side 122. The first side 121 is longer than the second side 122 and the second side 122 has a first feeding point 125 and a second feeding point 126.

The feeding gap 130 has a first end 131 located at the first side 121 and a second end 132 located at the second side 122. The feeding gap divides the radiation conductor 120 into a first sub-radiation conductor 123 and a second sub-radiation conductor 124. The first feeding point 125 is located in the area of the first sub-radiation conductor 126 at the second end 132 of the division gap 130 and the second feeding point 126 is located in the area of the second sub-radiation conductor 124 at the second end 132 of the division gap 130. Besides, in practical application, the first end 131 of the division gap 130 can be positioned such that the second sub-radiation conductor 124 has a length close to one-third length of the first side 121.

In the broadband antenna 100, a radio-frequency (RF) signal is received at the first feeding point 125 and the second feeding point 126 via a coaxial line to excite a first resonant mode and a second resonant mode of the radiation conductor 120. The second resonant mode is adjacent to the first resonant mode such that the antenna has one wide resonant mode formed by both the first and second resonant modes. Moreover, in practical application, the first end 131 of the feeding gap 130 can be positioned such that the length of the second sub-radiation conductor 124 is close to one-fourth wavelength of the second resonant mode.

Figure 2:
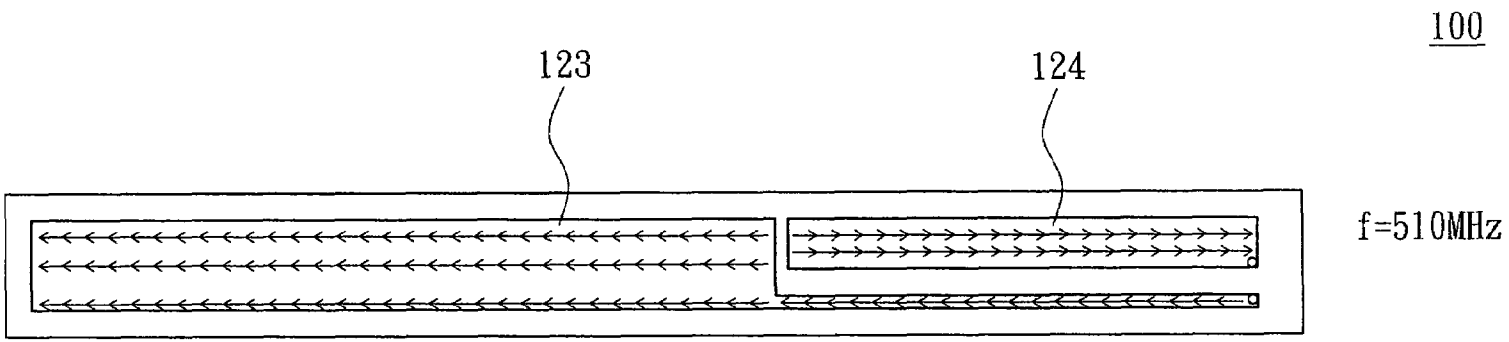
FIG. 2 is a schematic diagram of a current path of the antenna of FIG. 1 in the first resonant mode.
Figure 3:
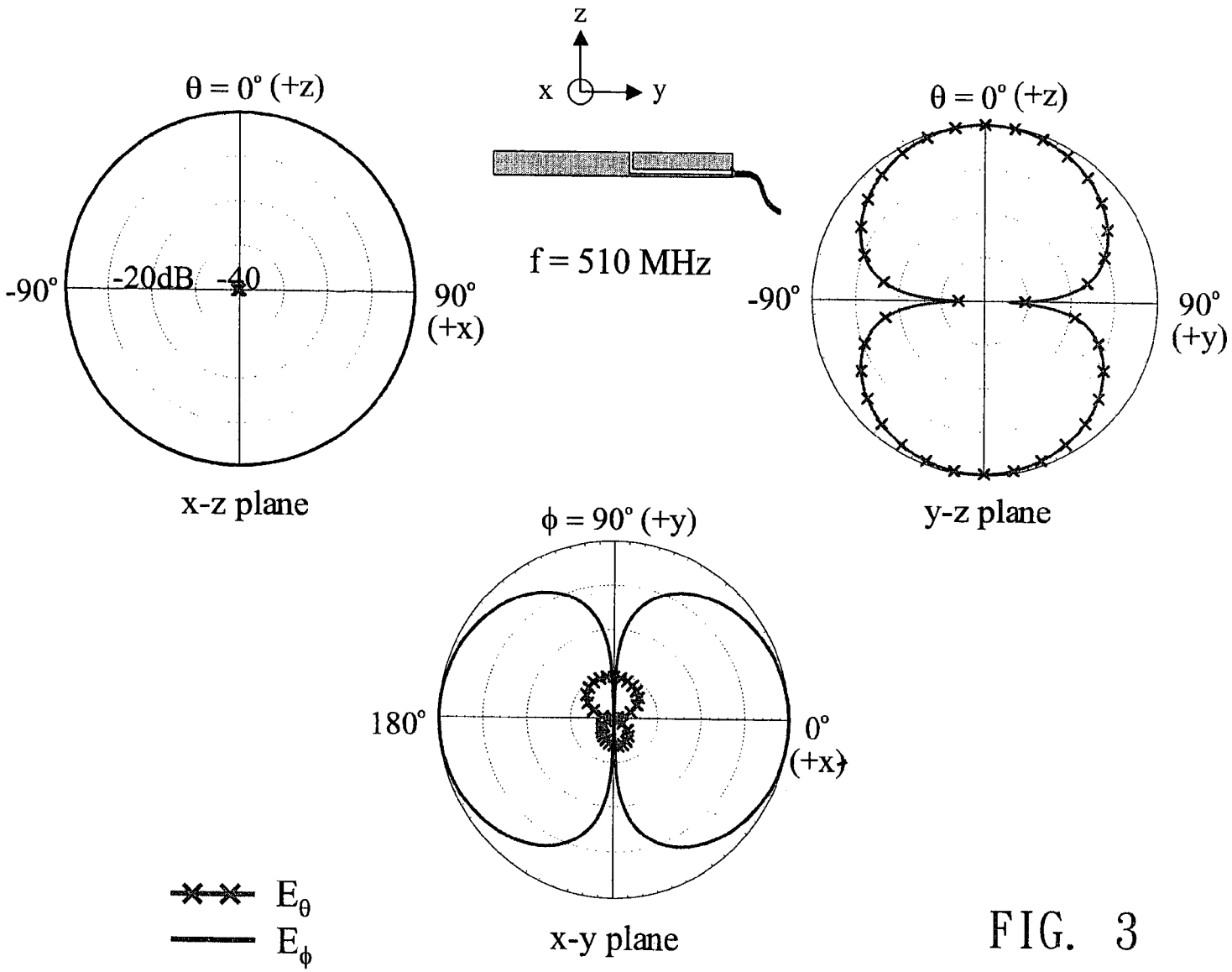
FIG. 3 is a radiation pattern of the broadband antenna at 510 MHz according to the preferred embodiment of the invention.

In the embodiment, the first side 121 is 215 mm long, the second side 122 is 10 mm long and the second sub-radiation conductor 124 is 74 mm long for instance. Referring to FIG. 2, a schematic diagram of a current path of the antenna 100 of FIG. 1 in the first resonant mode is shown. From FIG. 2, it can be seen that the radiation field generated by the current flowing through the second sub-radiation conductor 124 is cancelled with the radiation field generated by the current flowing through the region of the first sub-radiation conductor 123 located under the second sub-radiation conductor 124. According to the equation $c=f\times\lambda$, it can be known that the first resonant mode is excited at about 510 MHz. Referring to FIG. 3, a radiation pattern of the broadband antenna 100 at 510 MHz according to the preferred embodiment of the invention is shown. From FIG. 3, at 510 MHz, the antenna can generate a near-omnidirectional radiation pattern in the x-z plane (the horizontal plane); this characteristic is very suitable for broadband antenna application.

Figure 4:
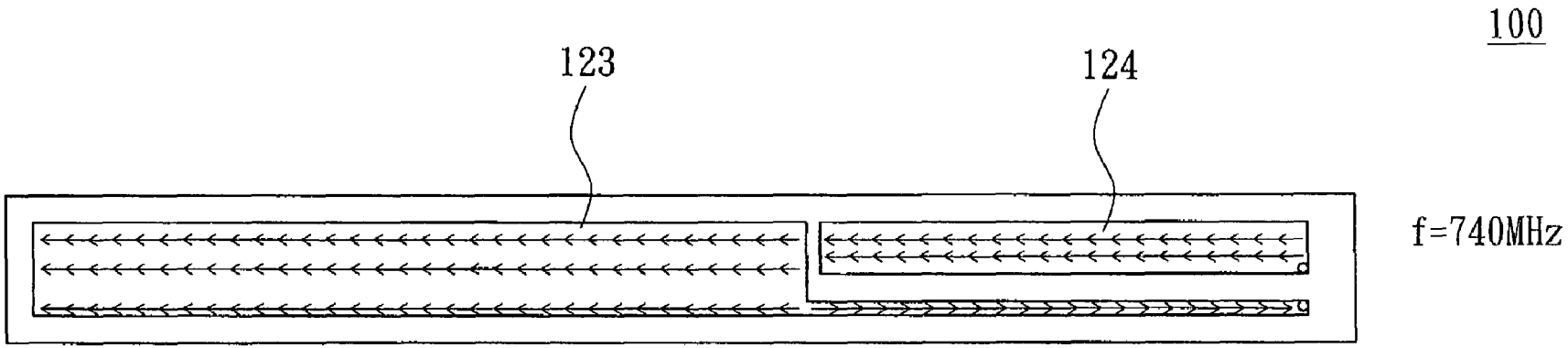
FIG. 4 is a schematic diagram of a current path of the antenna of FIG. 1 in the second resonant mode.
Figure 5:
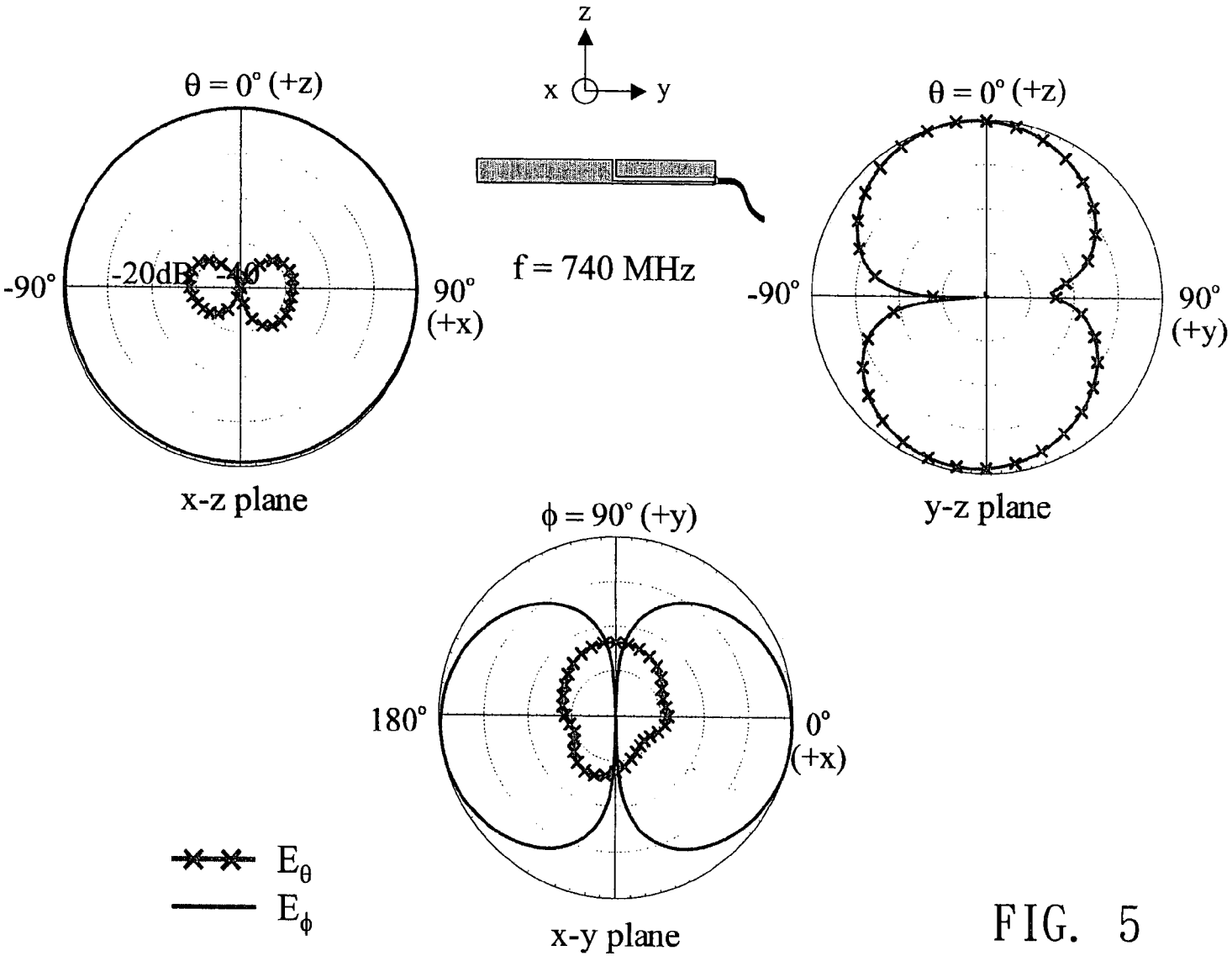
FIG. 5 is a radiation pattern of the broadband antenna at 740 MHz according to the preferred embodiment of the invention.

Referring to FIG. 4, a schematic diagram of a current path of the antenna 100 of FIG. 1 in the second resonant mode is shown. From FIG. 4, the radiation field generated by the current flowing through the second sub-radiation conductor 124 is cancelled by the radiation field generated by the current flowing through the region of the first sub-radiation conductor 123 located under the second sub-radiation conductor 124. The resonant path of the second resonant mode is twice as long as that of the first resonant mode. According to the equation $c=f\times\lambda$, it is known that the second resonant mode is excited at about 740 MHz. Referring to FIG. 5, a radiation pattern of the broadband antenna 100 at 740 MHz according to the preferred embodiment of the invention is shown. From FIG. 5, at 740 MHz, the antenna generates a near-omnidirectional radiation pattern in the x-z plane (the horizontal plane); this characteristic is very suitable for broadband antenna application.

Figure 6:
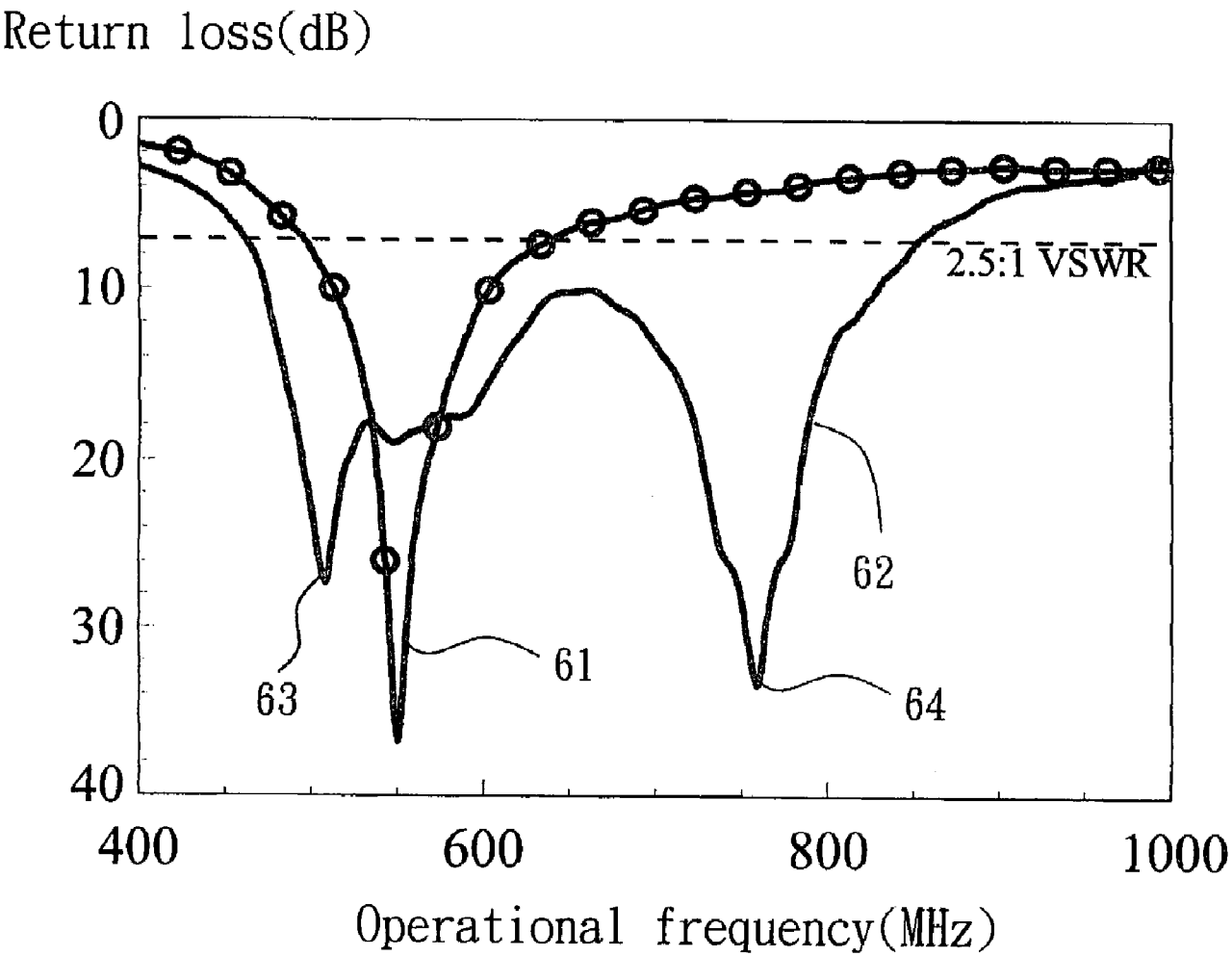
FIG. 6 is a comparison of the measured return loss for the broadband antenna according to the preferred embodiment of the invention and the corresponding conventional dipole antenna.

Referring to FIG. 6, a comparison of the measured return loss for the broadband antenna according to the preferred embodiment of the invention and the corresponding conventional dipole antenna is shown. In FIG. 6, the curve 62 is a return loss curve of the broadband antenna 100 in the invention and the curve 61 is a return loss curve of the corresponding conventional dipole antenna. The point 63 corresponds to the first resonant mode and the point 64 corresponds to the second resonant mode. Under the condition that the voltage standing wave ratio (VSWR) is 2.5, the broadband antenna 100 of the invention has a bandwidth of 470~860 MHz. This bandwidth is much larger than the bandwidth of 500~600 MHz of the corresponding conventional dipole antenna.

In Table 1, performances of a monopole antenna, a conventional dipole antenna and the broadband antenna of the embodiment are shown for comparison.

TABLE 1

| | Monopole antenna | Conventional dipole antenna | Broadband Antenna of the embodiment |
|---|---|---|---|
| Volume ($mm^3$) | 142 × 30 × 30 | 202 × 49 × 0.2 | 215 × 10 × 0.4 |
| Bandwidth (MHz) | 470~600 | 500~600 | 470~860 |
| Gain (dBi) | 2 | 2 | 2 |
| VSWR | <3 | <3 | <2.5 |

Figure 7:
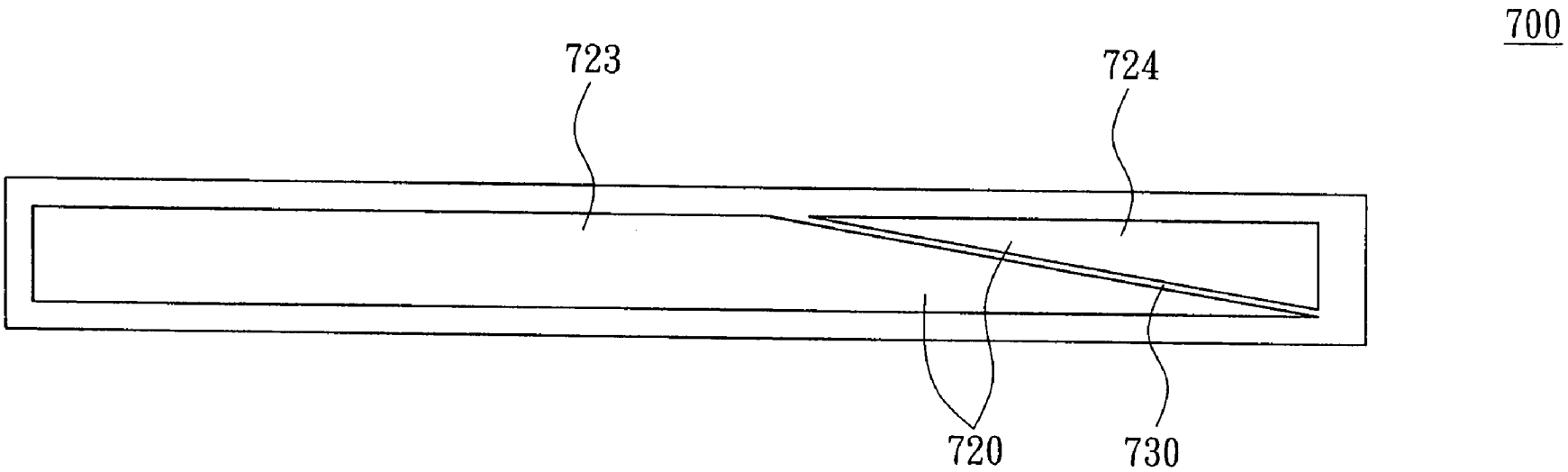
FIG. 7 is a schematic diagram of another broadband antenna according to the invention.
Figure 8:
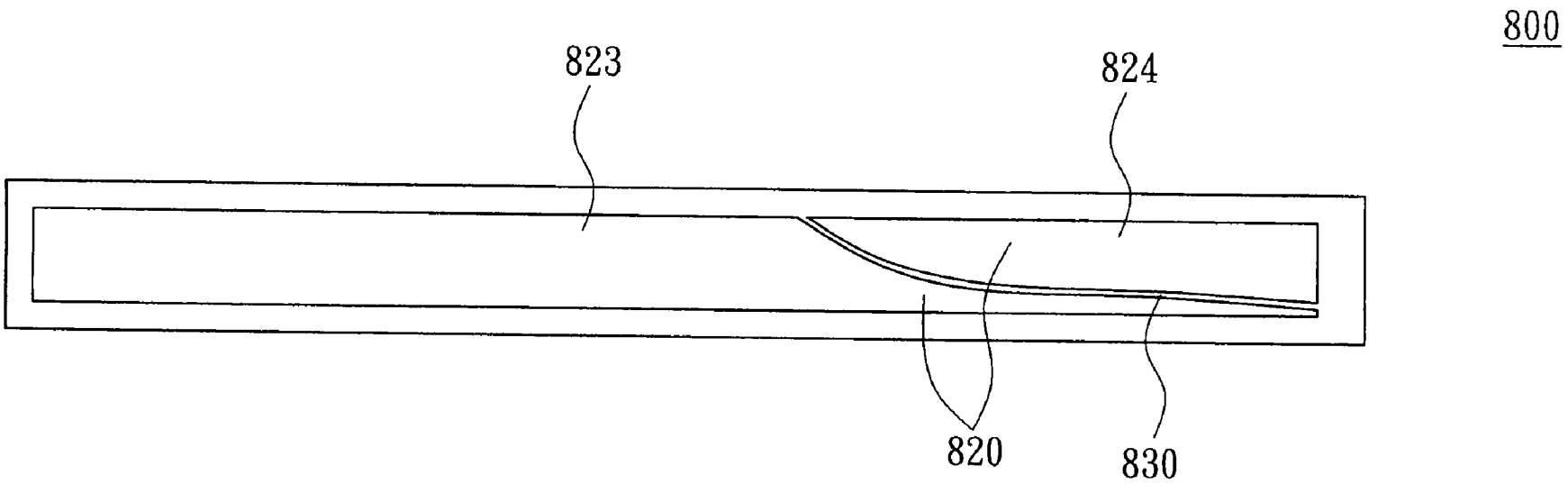
FIG. 8 is a schematic diagram of a third broadband antenna according to the invention.

From Table 1, the broadband antenna 100 of the invention has a lower VSWR, that is, a lower return loss and a larger bandwidth of 470~860 MHz, without reducing the gain level. This bandwidth is suitable for digital TV operation in many different countries. Furthermore, the broadband antenna 100 of the invention has a smaller area and thickness than the monopole antenna and conventional dipole antenna. Therefore, when the broadband antenna 100 is applied as a digital TV antenna in a car, it is very suitable to be attached to the windshield in front of the driver without affecting the sight of the driver and the car's appearance. In the above-mentioned broadband antenna 100, the feeding gap 130 is step-shaped. However, the shape of the feeding gap 130 is not restricted to just this. As long as the feeding gap 130 can divide the radiation conductor 120 into the first sub-radiation conductor 123 and the second sub-radiation conductor 124, it will not depart from the scope of the invention. Referring to FIG. 7, a schematic diagram of another broadband antenna according to the invention is shown. In the broadband antenna 700, the feeding gap 730 is line-shaped and divides the radiation conductor 720 into a first sub-radiation conductor 723 and a second sub-radiation conductor 724. Referring to FIG. 8, a schematic diagram of a third broadband antenna according to the invention is shown. In the broadband antenna 800, the feeding gap 830 is curve-shaped and divides the radiation conductor 820 into a first sub-radiation conductor 823 and a second sub-radiation conductor 824.

In the broadband antenna disclosed by the invention, signals are fed into one short side of the antenna, and thus the coaxial line used as a feeding circuit oriented along the direction of the antenna radiation conductor. Therefore, the antenna can have a smaller area and thickness, and a larger bandwidth, which is suitable for antenna application in various bands. In addition, when applied as a digital TV antenna in a car, the broadband antenna of the invention can be attached to the car's windshield and still achieve good performance without affecting the sight of the driver and the car's appearance.

While the invention has been described by way of example and in terms of three preferred embodiments, it is understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A DVB-T broadband antenna applied in a digital TV system, comprising:

a dielectric substrate;

a radiation conductor, disposed on the dielectric substrate, the radiation conductor having a first side and a second side, wherein the first side is adjacent to the second side, the first side is longer than the second side, and the second side has a first feeding point and a second feeding point for receiving a radio-frequency (RF) signal to generate a first resonant mode of the radiation conductor; and a feeding gap, having a first end located at the first side and a second end located at the second side, wherein the feeding gap divides the radiation conductor into a first sub-radiation conductor and a second sub-radiation conductor;

wherein the first feeding point is located on the first sub-radiation conductor and the second feeding point is located on the second sub-radiation conductor;

wherein the first end of the feeding gap is located at the first side such that the length of the second sub-radiation conductor is close to one-third of the length of the first side and a length of the second sub-radiation conductor is substantially equal to one-eighth wavelength of the first resonant mode.

2. broadband antenna according to claim 1, wherein the radiation conductor is a radiation metal plate.

3. The broadband antenna according to claim 1, wherein the radiation conductor is made of indium tin oxide (ITO).

4. The broadband antenna according to claim 1, wherein the feeding gap is step-shaped.

5. The broadband antenna according to claim 1, wherein the feeding gap is line-shaped.

6. The broadband antenna according to claim 1, wherein the feeding gap is curve-shaped.

7. The broadband antenna according to claim 1, wherein the radio-frequency (RF) signal is received at the first and second feeding points to generate a second resonant mode of the radiation conductor, the second resonant mode being adjacent to the first resonant mode, such that the antenna has one wide resonant mode formed by both the first and second resonant modes.

8. The broadband antenna according to claim 7, wherein the first end of the feeding gap is located at the first side such that the length of the second sub-radiation conductor is close to one-fourth wavelength of the second resonant mode.

9. The broadband antenna according to claim 1, wherein the RF signal is transmitted via a coaxial line.

10. A broadband antenna, comprising:

a dielectric substrate;

a radiation conductor, disposed on the dielectric substrate, the radiation conductor having a first side and a second side, wherein the first side is adjacent to the second side, the first side is longer than the second side, and the second side has a first feeding point and a second feeding point; and a feeding gap, having a first end located at the first side and a second end located at the second side, wherein the feeding gap divides the radiation conductor into a first sub-radiation conductor and a second sub-radiation conductor and the feeding gap has a shape of a straight line such that the second sub-radiation conductor is triangular;

wherein the first feeding point is located on the first sub-radiation conductor and the second feeding point is located on the second sub-radiation conductor.

11. A broadband antenna, comprising:

a dielectric substrate;

a radiation conductor, disposed on the dielectric substrate, the radiation conductor having a first side and a second side, wherein the first side is adjacent to the second side, the first side is longer than the second side, and the second side has a first feeding point and a second feeding point; and a feeding gap, having a first end located at the first side and a second end located at the second side, wherein the feeding gap divides the radiation conductor into a first sub-radiation conductor and a second sub-radiation conductor, and the feeding gap has a shape of a curve line such that the second sub-radiation has a knife-shape with its point located at the first side;

wherein the first feeding point is located on the first sub-radiation conductor and the second feeding point is located on the second sub-radiation conductor.

* * * * *